US008248352B2

(12) United States Patent
Kim et al.

(10) Patent No.: US 8,248,352 B2
(45) Date of Patent: Aug. 21, 2012

(54) DRIVING CIRCUIT OF LIQUID CRYSTAL DISPLAY

(75) Inventors: Jin-Ho Kim, Gyeonggi-Do (KR); Hong-Jae Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 813 days.

(21) Appl. No.: 12/318,301

(22) Filed: Dec. 24, 2008

(65) Prior Publication Data

US 2009/0267883 A1 Oct. 29, 2009

(30) Foreign Application Priority Data

Apr. 25, 2008 (KR) ..... 10-2008-038957
Apr. 25, 2008 (KR) ..... 10-2008-038958

(51) Int. Cl.
*G09G 3/36* (2006.01)

(52) U.S. Cl. ..... 345/99; 345/87

(58) Field of Classification Search ..... 345/87, 345/98, 100, 103, 99
See application file for complete search history.

(56) References Cited

U.S. PATENT DOCUMENTS

2004/0257322 A1* 12/2004 Moon ..... 345/87
2005/0174299 A1* 8/2005 Park et al. ..... 345/1.1
2005/0195141 A1* 9/2005 Takeda ..... 345/87
2006/0279511 A1* 12/2006 Uh et al. ..... 345/100
2008/0048709 A1* 2/2008 Lee et al. ..... 324/770
2008/0170064 A1* 7/2008 Lee ..... 345/214
2008/0204390 A1* 8/2008 Moon ..... 345/87
2008/0224980 A1* 9/2008 Senda et al. ..... 345/96
2009/0168004 A1* 7/2009 Kim et al. ..... 349/139
2009/0295784 A1* 12/2009 Kwon et al. ..... 345/213

* cited by examiner

*Primary Examiner* — Ricardo L Osorio
(74) *Attorney, Agent, or Firm* — Morgan, Lewis & Bockius LLP

(57) ABSTRACT

A driving circuit of a liquid crystal display includes: a timing controller to output a gate control signal and a data control signal to control driving of a gate driving unit and a data driving unit and to output digital video data; a pair of gate driving units to be alternately driven by using at least one frame as a period to supply gate signals to gate lines of a liquid crystal panel in-response to the gate control signal; and a data driving unit to supply pixel signals to data lines of the liquid crystal panel in response to the data control signal. Degradation of characteristics of transistors constituting each gate driver can be prevented.

6 Claims, 16 Drawing Sheets

DRIVING CIRCUIT OF LIQUID CRYSTAL DISPLAY

BACKGROUND OF THE INVENTION

1. Field of the Invention

The present invention relates to a technique for driving a liquid crystal panel of a liquid crystal display (LCD) and, more particularly, to a driving circuit of an LCD capable of preventing degradation of characteristics of transistors constituting a gate driving unit, an element of a gate driving unit.

2. Description of the Related Art

Recently, as the information technology (IT) is advancing, the importance of a flat panel display device is further emphasized as a visual information transmission medium, and in order to obtain a competitive edge in the future, the flat panel display device is required to have low power consumption, to be thinner and lighter, and to have high picture quality. A liquid crystal display (LCD), a typical display device of the flat panel display devices, displays an image by using optical anisotropy of liquid crystal. With the advantages of being thinner and smaller and having low power consumption and high picture quality, the LCD is widely applied for display devices of various mobile terminals such as a TV receiver or the like.

The LCD is a display device in which image information is individually supplied to liquid crystal pixels arranged in a matrix form to control light transmittance of the liquid crystal pixels to thereby display a desired image. Thus, the LCD includes a liquid crystal panel with liquid crystal pixels, the minimum unit for implementing an image, arranged in a matrix form and a driver for driving the liquid crystal panel. Because the LCD does not emit light by itself, it includes a backlight unit to provide light to the LCD. The driver includes a data driving unit and a gate driving unit as well as a timing controller.

FIG. 1 is a block diagram of a related art LCD. As shown in FIG. 1, the related art LCD includes a timing controller 14 that outputs a gate control signal GDC and a data control signal DDC for controlling driving of a gate driving unit 12 and a data driving unit 13, samples digital video data RGB, realigns them, and outputs the same; the gate driving unit 12 that supplies gate signals to gate lines GL0~GLn of a liquid crystal panel 14 in response to the gate control signal GDC; a data driving unit 13 that supplies pixel signals to data lines DL1~DLm of the liquid crystal panel 14 in response to the data control signal DDC; and the liquid crystal panel 14 including liquid crystal cells arranged in a matrix form and driven by the gate signals and the pixel signals to display an image. The operation of the LCD will now be described with reference to FIGS. 2 to 7.

The timing controller 11 outputs the gate control signal GDC for controlling the gate driving unit 12 and the data control signal DDC for controlling the data driving unit 13 by using a vertical/horizontal synchronization signals (Hsync/Vsync) supplied from a system. Also, the timing controller 11 samples digital pixel data RGB inputted from the system, realigns the same and supplies it to the data driving unit 13.

The gate control signal GDC includes a gate start pulse GSP, a gate shift clock signal GSC, a gate out enable signal GOE, or the like, and the data control signal DDC includes a source start pulse SSP, a source shift clock signal SSC, a source out enable signal SOE, and a polarity signal POL.

The gate driving unit 12 sequentially supplies gate signals to the gate lines GL1~GLn in response to the gate control signal GDC inputted from the timing controller 11, and accordingly, thin film transistors TFTs in the horizontal lines are turned on. Accordingly, pixel signals supplied via the data lines DL1~DLm are stored in each storage capacitor Cst via the TFTs.

In detail, the gate driving unit 12 shifts the gate start pulse GSP according to the gate shift clock GSC to generate a shift pulse. The gate driving unit 12 supplies a gate signal including a gate-on and gate-off intervals (signals) to a corresponding gate line GL at every horizontal period in response to the shift clock. In this case, the gate driving unit supplies a gate-on signal only during an enable period in response to the gate out enable signal GOE, and supplies a gate-off signal during other period.

In response to the data control signal DDC inputted from the timing controller 11, the data driving unit 13 converts the pixel data RGB into an analog pixel signal (data signal or data voltage) corresponding to a gray scale value of the pixel data RGB, and supplies the converted pixel signal to the data lines DL1~DLm on the liquid crystal panel 14.

The liquid crystal panel 14 includes a plurality of liquid crystal cells $C_{LC}$ arranged in a matrix form and TFTs formed at every crossing of the data lines DL1~DLm and gate lines GL1~GLn and connected to each liquid crystal cell $C_{LC}$. When the gate signals are supplied from the gate lines GL, the TFTs are turned on to supply the pixel signals supplied via the data lines DL to the liquid crystal cells $C_{LC}$. When the gate off signal is supplied through the gate lines GL, the TFTs are turned off to allow the pixel signal charged in the liquid crystal cell $C_{LC}$ to be maintained.

The liquid crystal cell $C_{LC}$ includes a common electrode and a pixel electrode connected with the TFTs with liquid crystals interposed therebetween. The liquid crystal cell $C_{LC}$ further includes a storage capacitor $C_{ST}$ in order to stably maintain the charged pixel signal until a next pixel signal is charged. The storage capacitor $C_{ST}$ is formed between the pixel electrode and a gate line of a previous stage. In the liquid crystal cell $C_{LC}$, the arrangement of liquid crystals having dielectric anisotropy varies according to the pixel signal charged through the TFT, and accordingly, the light transmittance is adjusted to implement gray scales.

As shown in FIG. 2, the gate driving unit 12 includes gate drivers GD1~GDn operating according to a shift register method, and outputs gate signals VGOUT[1]~VGOUT[N] at the same timing as that shown in FIG. 3 by a clock signal CLK, a start signal VST and a reset signal RST supplied from the timing controller 11. Namely, after the start signal VST is inputted, the gate drivers GD1~GDn sequentially output the gate signals VGOUT[1]~VGOUT[N] in synchronization with corresponding clock signals CLK[1]~CLK[N]. The gate lines GL1~GLn on the liquid crystal panel 14 are driven by the thusly outputted gate signals VGOUT[1]~VGOUT[N]. The operation of generating the gate signals VGOUT[1]~VGOUT[N] is repeated by frames.

FIG. 4 is a detailed circuit diagram showing the gate drivers GD1~GDn. A first AND gate AD11 ANDs control signals CTL supplied from the timing controller 11 and supplies a set signal (S) of an RS flipflop FF11, and a second AND gate AD12 ANDs the control signals CTL and supplies a reset signal (R) of the flipflop FF11. The RS flipflop FF11 are operated by the supplied set signal (S) and the reset signal (R) to output the opposite logic signals as shown in FIG. 5 to its output terminals Q and QB.

In other words, when a gate high voltage $V_{GH}$ is outputted to the output terminal (Q) of the RS flipflop FF11, a large-size charging transistor $T_U$ is turned on, and at this time, a small-size discharging transistor $T_{PD}$ is turned off by a gate low voltage $V_{GL}$ outputted from the inversion output terminal QB of the RF flipflop FF11. In this state, when the clock signal CLK is supplied, the gate high voltage VGH is supplied to the corresponding gate line GL from the charging transistor $T_U$.

Thereafter, in a discharge mode, the discharging transistor $T_{PD}$ is turned on by the gate high voltage $V_{GH}$ outputted from the inversion output terminal QB of the RS flipflop FF11. Accordingly, the gate high voltage $V_{GH}$, charging voltage of the gate line GL, is discharged via the discharging transistor $T_{PD}$ and maintained as a gate low voltage $V_{GL}$.

The charging transistor $T_{PU}$ and the discharging transistor $T_{PD}$ are implemented as an a-Si:H TFT. When a positive polarity DC voltage is supplied between a source electrode and a gate electrode in such a transistor, a threshold voltage is increased to degrade the characteristics to reduce an output current.

In this respect, as shown in FIG. 5, it is noted that a high level voltage is outputted from the output terminal (Q) of the RS flipflop FF11 to a gate electrode of the charging transistor $T_U$ during a short time corresponding to a charge time of the gate line. Thus, the charging transistor $T_U$ can receive a stress voltage during the short time period.

In comparison, it is noted that a high level voltage is outputted from the output terminal QB of the RF flipflop FF11 to a gate electrode of the discharging transistor $T_{PD}$ during a long time excluding the charge time of the gate line. Thus, the discharging transistor $T_{PD}$ receives the stress voltage during a relatively even longer time compared with that of the charging transistor $T_U$.

Thus, in the related art LCD, when the gate driving unit outputs the gate signals to the respective gate lines of the liquid crystal panel, the high level gate voltage is supplied to the charging transistor during a short time period, so degradation of characteristics proceeds relatively slow. Meanwhile, the discharging transistor at each gate driving unit receives the gate voltage of high level during a longer time compared with that of the charging transistor, so degradation of characteristics proceeds fast as much. This results in lengthening of a discharge time of the gate lines, causing a problem in that an interval, which is to be maintained in an OFF state, is not turned off to output an abnormal voltage.

In addition, the charging transistor $T_U$ and the discharging transistor $T_D$ are implemented by a-Si:H, having a disadvantage that the charging transistor $T_{PU}$ an the discharging transistor $T_{PD}$ have low mobility. Thus, the related art LCD has the problem that gate lines are not discharged within a line time.

SUMMARY OF THE INVENTION

Therefore, in order to address the above matters, the various features described herein have been conceived. One aspect of the exemplary embodiments is to prevent degradation of characteristics of transistors constituting each gate driver, elements of a gate driving unit, in implementing the gate driving unit that supplies gate signals to a liquid crystal panel of a liquid crystal display (LCD).

This specification provides a driving circuit of an LCD, including: a timing controller to output a gate control signal and a data control signal to control driving of a gate driving unit and a data driving unit and to output digital video data; a pair of gate driving units to be alternately driven by using at least one frame as a period to supply gate signals to gate lines of a liquid crystal panel in response to the gate control signal; and a data driving unit to supply pixel signals to data lines of the liquid crystal panel in response to the data control signal.

The foregoing and other objects, features, aspects and advantages of the present invention will become more apparent from the following detailed description of the present invention when taken in conjunction with the accompanying drawings.

DETAILED DESCRIPTION OF THE INVENTION

Exemplary embodiments of the present invention will now be described in detail with reference to the accompanying drawings.

First, a driving circuit of a liquid crystal display (LCD) according to a first embodiment of the present invention will now be described with reference to FIGS. 6 to 13.

Figure 1:
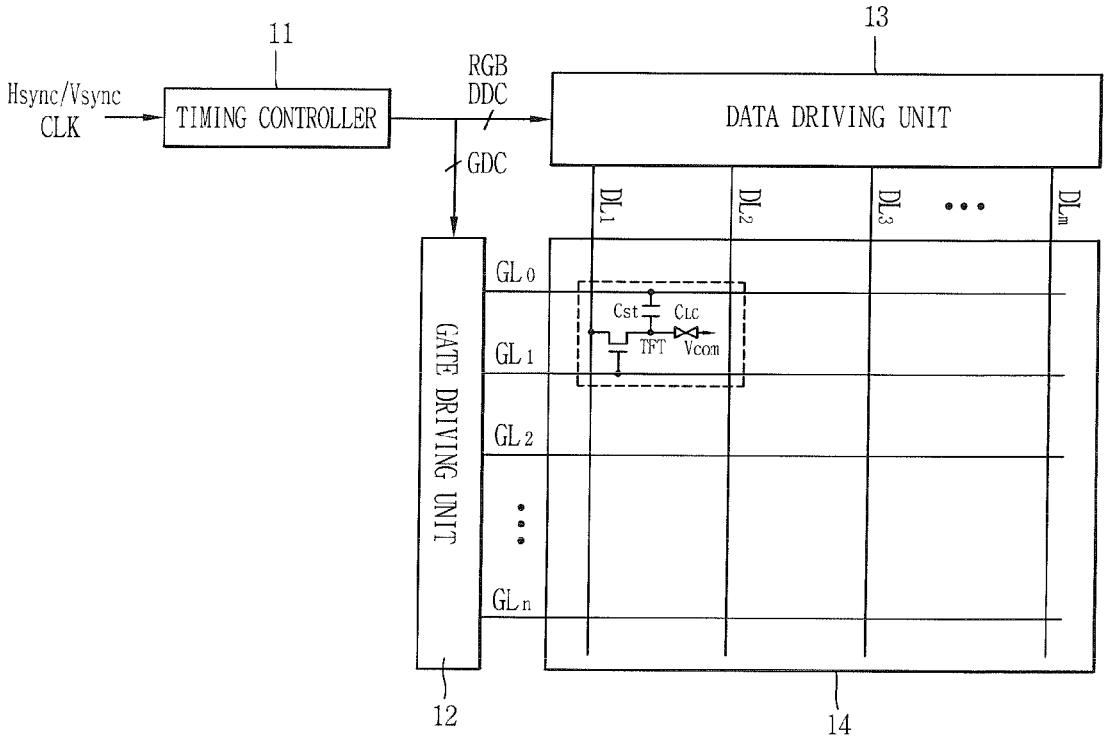
FIG. 1 RELATED ART
FIG. 1 is a driving block diagram of a related art liquid crystal display (LCD)
Figure 2:
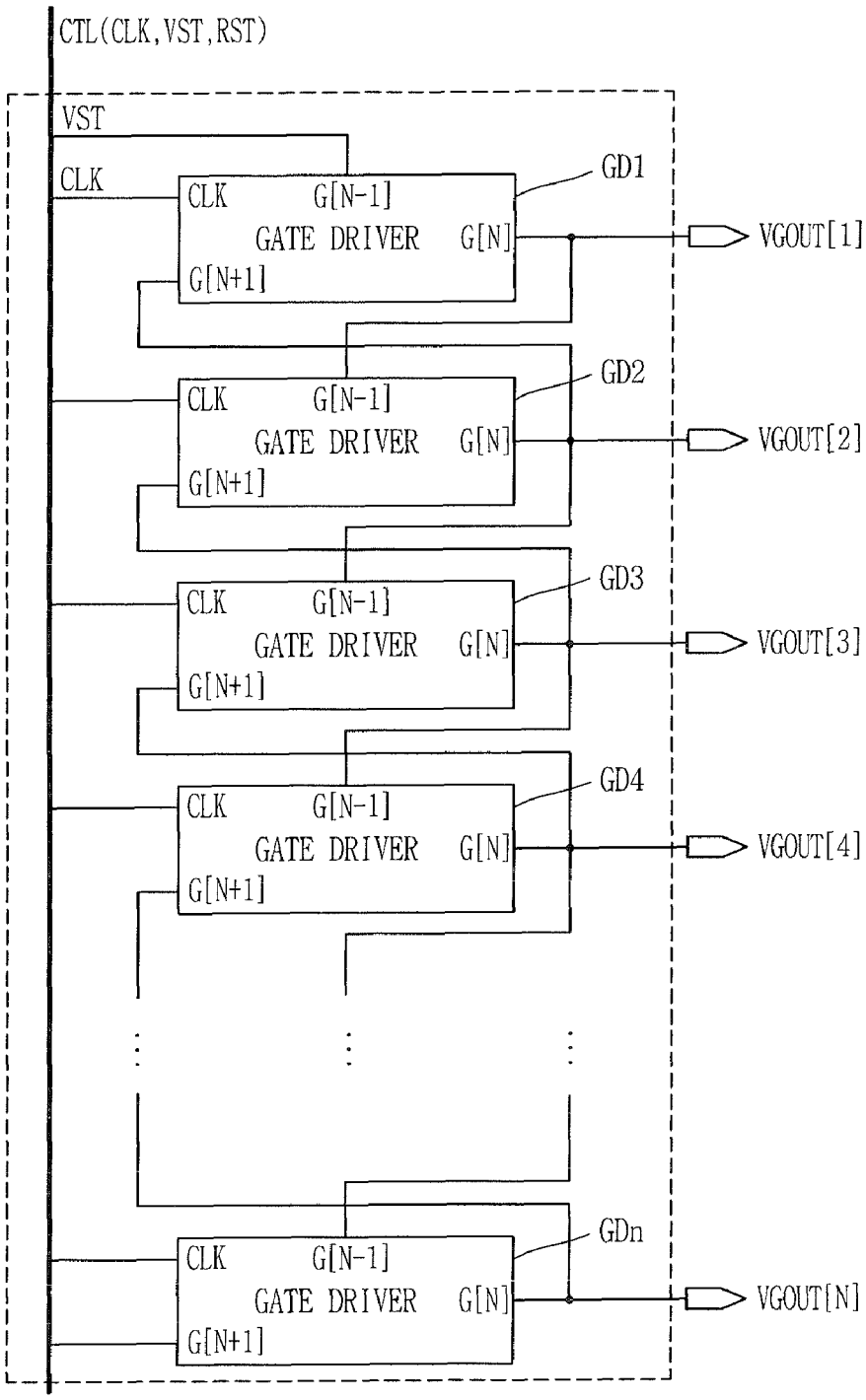
FIG. 2 RELATED ART
FIG. 2 is a detailed block diagram of a gate driving unit in FIG. 1.
Figure 3:
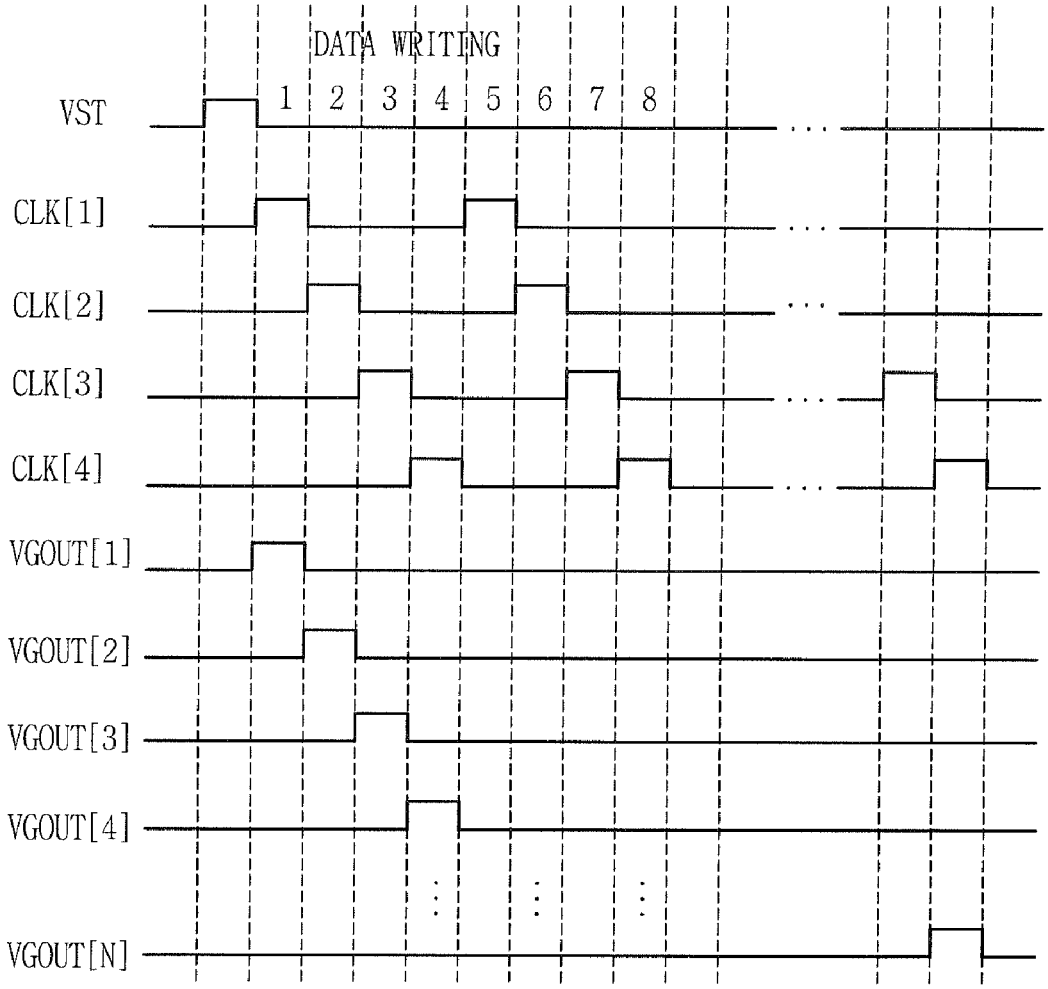
FIG. 3 RELATED ART
FIG. 3 shows waveforms of each part in FIG. 2.
Figure 4:
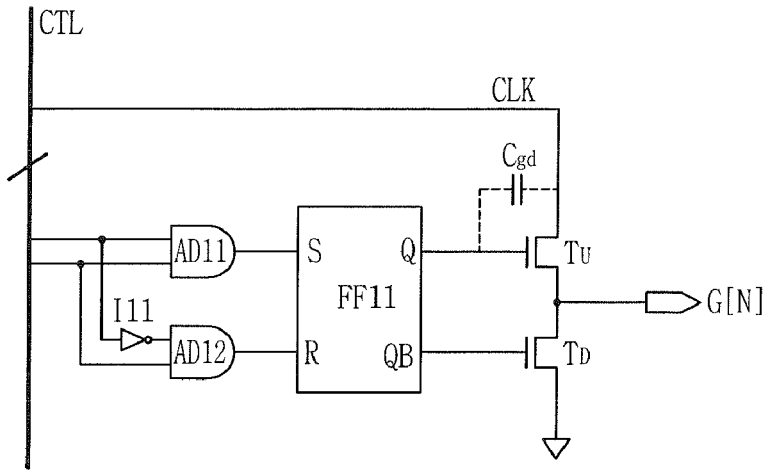
FIG. 4 RELATED ART
FIG. 4 is a circuit diagram of a gate driver in FIG. 2.
Figure 5:
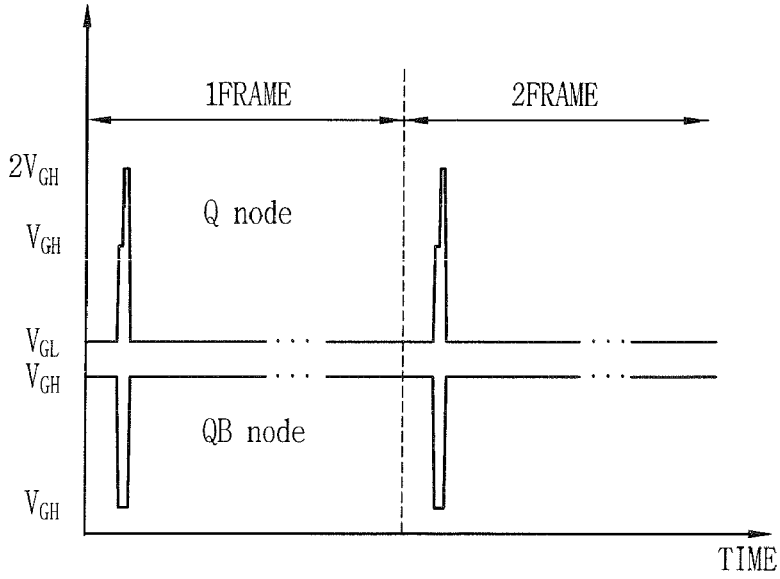
FIG. 5 RELATED ART
FIG. 5 is a view showing an output signal timing of an RS flipflop in FIG. 4.
Figure 6:
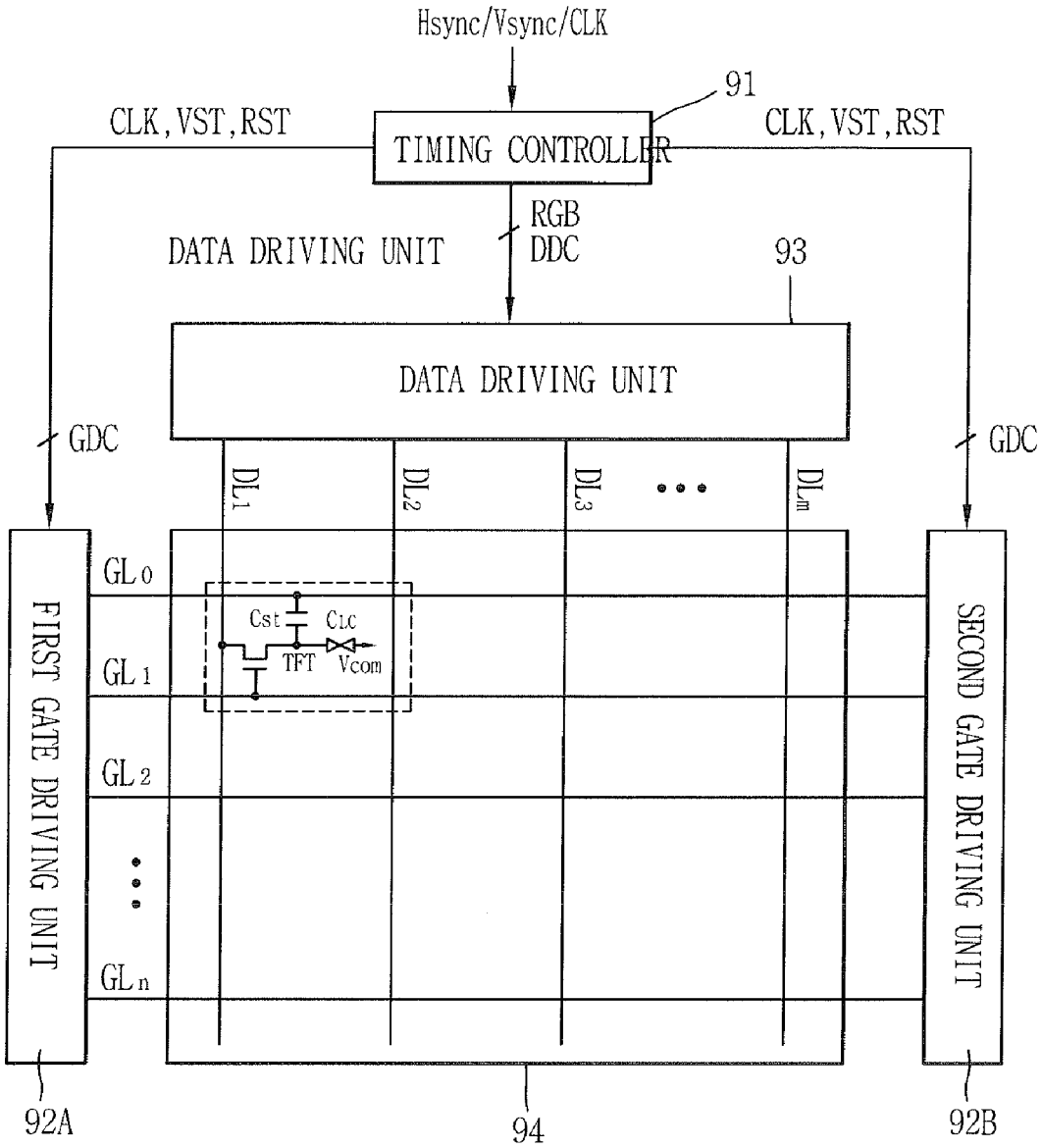
FIG. 6 is a block diagram of a driving circuit of an LCD according to a first embodiment of the present invention.

FIG. 6 is a block diagram of driving circuit of an LCD according to a first embodiment of the present invention. With reference to FIG. 6, the driving circuit of the LCD according to the first embodiment of the present invention includes: a timing controller 91 that outputs a gate control signal GDC and a data control signal DDC for controlling driving of a gate driving unit 92 and a data driving unit 93, samples digital video data RGB, realigns them, and outputs the same; a pair of gate driving units 91 and 92 that alternately supply gate signals to gate lines GL0~GLn of a liquid crystal panel 94 in response to the gate control signal GDC; a data driving unit 93 that supplies pixel signals to data lines DL1~DLm of the liquid crystal panel 94 in response to the data control signal DDC; and the liquid crystal panel 94 including liquid crystal cells arranged in a matrix form and driven by the gate signals and the pixel signals to display an image.

Figure 7:
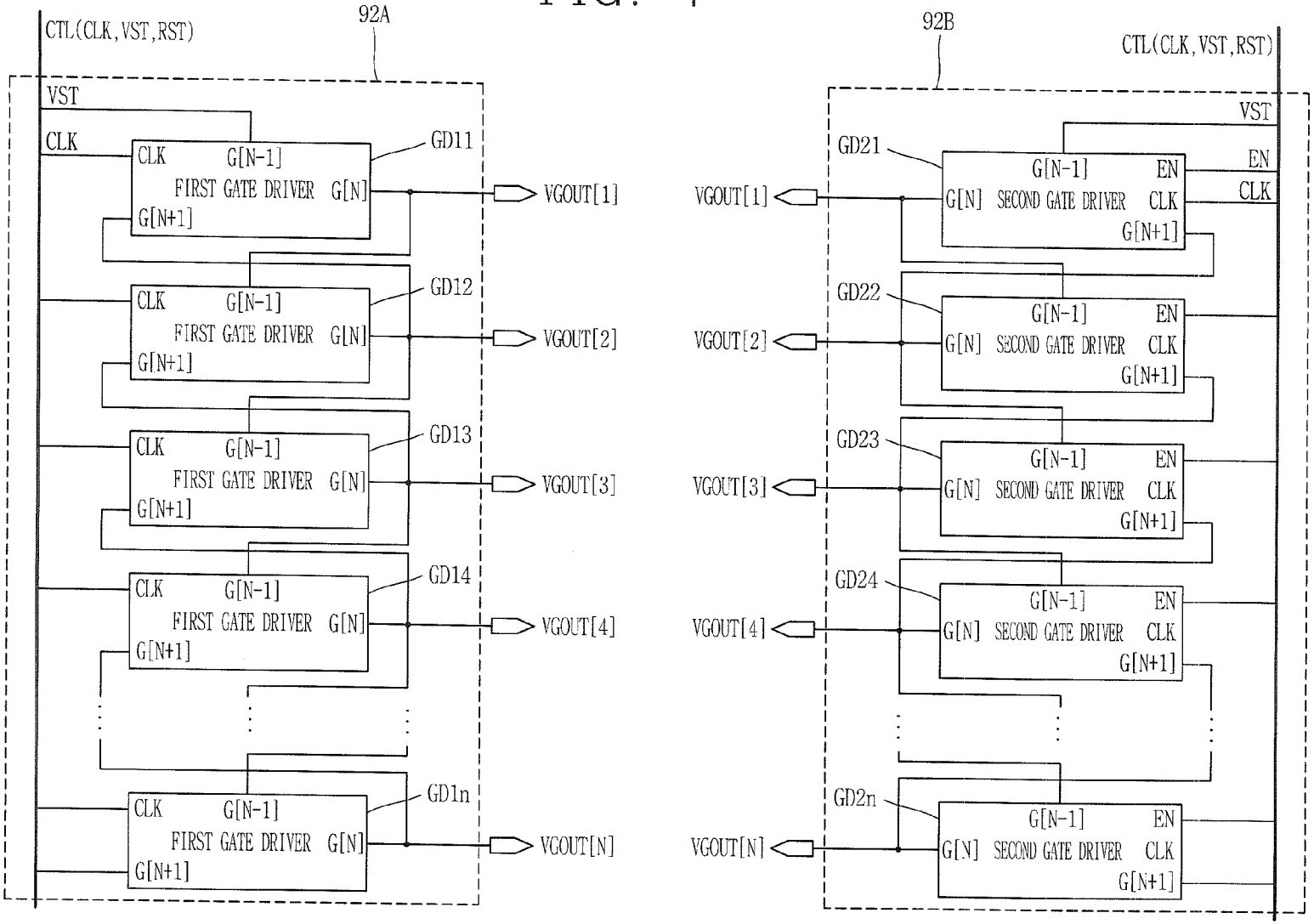
FIG. 7 is a detailed block diagram of gate driving units in FIG. 6.

FIG. 7 is a detailed block diagram of the gate driving units in FIG. 6. With reference to FIG. 7, the gate driving units 91 and 92 include gate drivers GD11~GD1*n* and GD21~GD2*n* driven according to a shift register method and alternately selected to be driven by an enable signal ENA supplied from the timing controller 19 by using a single frame as a period to output gate signals VGOUT[1]~VGOUT[N]. The gate driving units 91 and 92 include the first gate driving unit 91 and the second gate driving unit 92, and the gate drivers GD11~GD1*n* and GD21~GD2*n* include the first gate drivers GD11~GD1*n* and second gate drivers GD21~GD2*n*.

Figure 8:
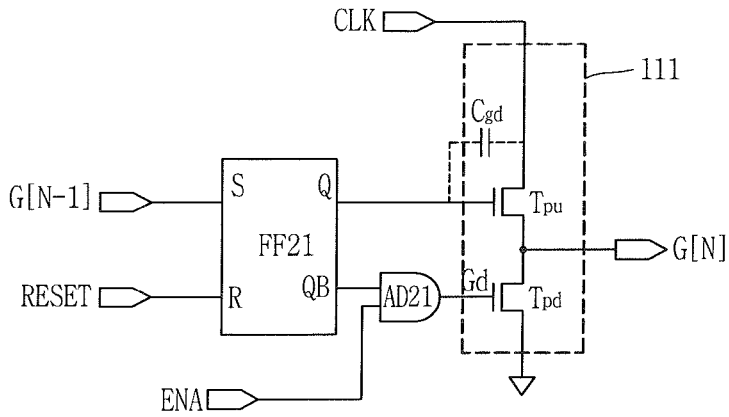
FIG. 8 is a circuit diagram of a gate driver in FIG. 7.

FIG. 8 is a circuit diagram of the gate drivers GD11~GD1*n* and GD21~GD2*n* in FIG. 7. As shown, each gate driver includes an RS flipflop FF21 that outputs the opposite logic signal to two output terminals Q and QB according to a set signal and a re-set signal; an AND gate AD21 that ANDs a signal outputted from the inversion output terminal QB of the RS flipflop FF21 and an enable signal ENA to validate (effectuate) them at an odd number or even number frame period; and a charging transistor $T_{PU}$ ad a discharging transistor $T_{PD}$ connected in series between a terminal of a clock signal CLK and a ground terminal, having gate electrodes respectively connected to the output terminal Q and to the inversion output terminal QB of the RS flipflop FF21 to generate a gate signal G[N] from a common connection point of a drain electrode and a source electrode.

The operation of the driving circuit of the LCD according to the first embodiment of the present invention will now be described in detail with reference to FIGS. 9 to 13.

With reference to FIG. 6, the first and second gate driving units 92A and 92B are alternately driven by using at least one frame as a period to output gate signals to the gate lines GL1~GLn of the liquid crystal panel 94. Operations at other parts are performed in the same manner as those in the general LCD.

Namely, the timing controller 19 outputs the gate control signal GDC for controlling the gate driving units 92A and 92B and the data control signal DDC for controlling the data driving unit 93 by using vertical/horizontal synchronization signals (Hsync/Vsync) and a clock signal CLK supplied from a system. And, the timing controller 91 samples digital pixel data RGB inputted from the system, realigns them, and supplies the same to the data driving unit 93.

The gate control signal includes a gate start pulse GSP, a gate shift clock signal GSC, a gate out enable signal GOE, or the like, and the data control signal DDC includes a source start pulse SSP, a source shift clock signal SSC, a source out enable signal SOE, and a polarity signal POL.

In response to the gate control signal GDC inputted from the timing controller 91, the first and second driving units 92A and 92B are alternately driven by using at least one frame as a period to supply gate signals to the gate lines GL1~GLn of the liquid crystal panel 94. Accordingly, corresponding TFTs in a corresponding horizontal line are turned on. Accordingly, the pixel signals supplied through the data lines DL1~DLm are stored in each storage capacitor $C_{ST}$ through the TFTs.

In response to the data control signal DDC inputted from the timing controller 91, the data driving unit 93 converts the pixel data into analog pixel signals corresponding to a gray scale value and supplies the converted pixel signals to the data lines DL1~DLm of the liquid crystal panel 94.

The liquid crystal panel 94 includes a plurality of liquid crystal cells $C_{LC}$ arranged in a matrix form and the TFTs formed at each crossing of the data lines DL1~DLm and the gate lines GL1~GLn and connected to the liquid crystal cells $C_{LC}$. The TFTs are turned on when gate signals are supplied from the gate lines GL, to supply pixel signals supplied through the data lines DL to the liquid crystal cells $C_{LC}$. When a gate off signal is supplied through the gate lines GL, the TFTs are turned off to allow the pixel signals charged in the liquid crystal cells $C_{LC}$ to be maintained. In the liquid crystal cells $C_{LC}$, the arrangement of liquid crystals having dielectric anisotropy varies according to the pixel signals charged through the TFTs, and accordingly, light transmittance is adjusted to implement gray scales.

In the present invention, the pair of gate driving units 92A and 92B are provided and are alternately driven by using a single frame as a period to supply gate signals to the gate lines GL1~GLn of the liquid crystal panel 94 each time.

Here, the case where the first gate driving unit 92A operates during the odd number frame and the second gate driving unit 92B operates during the even number frame is taken as an example, but the present invention is not limited thereto, and various other examples can be possible, for example, the first gate driving unit 92A may operate during the even number frame and the second gate driving unit 92B operate at the odd number frame without departing from the sprit or scope of the present invention.

Figure 10:
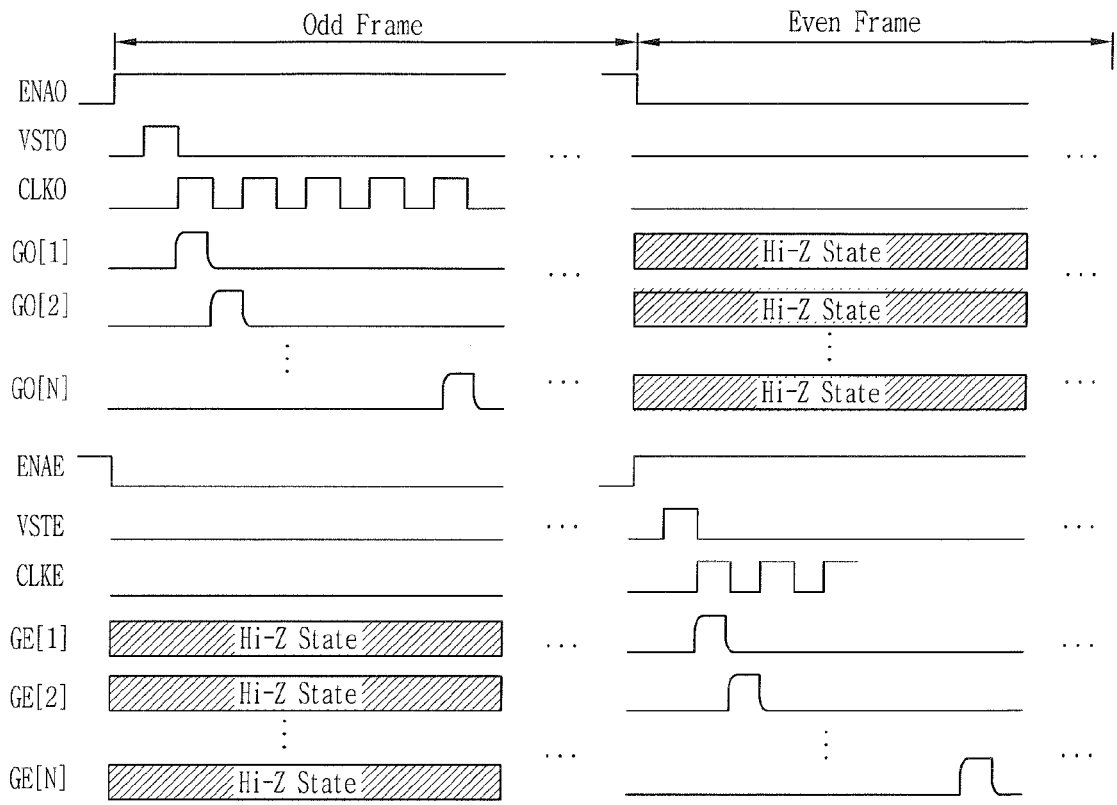
FIG. 10 is a timing diagram of each frame of two gate driving units in FIG. 9.

As shown in FIG. 10, the pair of gate driving units 92A and 92B include the gate drivers GD11~GD1*n* include gate drivers GD11~GD1*n* and GD21~GD2*n* operating according to a shift register method, respectively, are driven by the enable signal ENA supplied from the timing controller 91, and output gate signals VGOUT[1]~VGOUT[N] to the gate lines GL1~GLn of the liquid crystal panel 94 according to the clock signal CLK, the start signal VST and the reset signal RST.

FIG. 8 shows an example of the gate drivers GD11~GD1*n* and GD21~GD2*n*. Only one of the gate drivers GD11~GD1*n* and GD21~GD2*n* is illustrated for the sake of brevity. The operation of the gate drivers will now be described with reference to FIG. 9.

Figure 9:
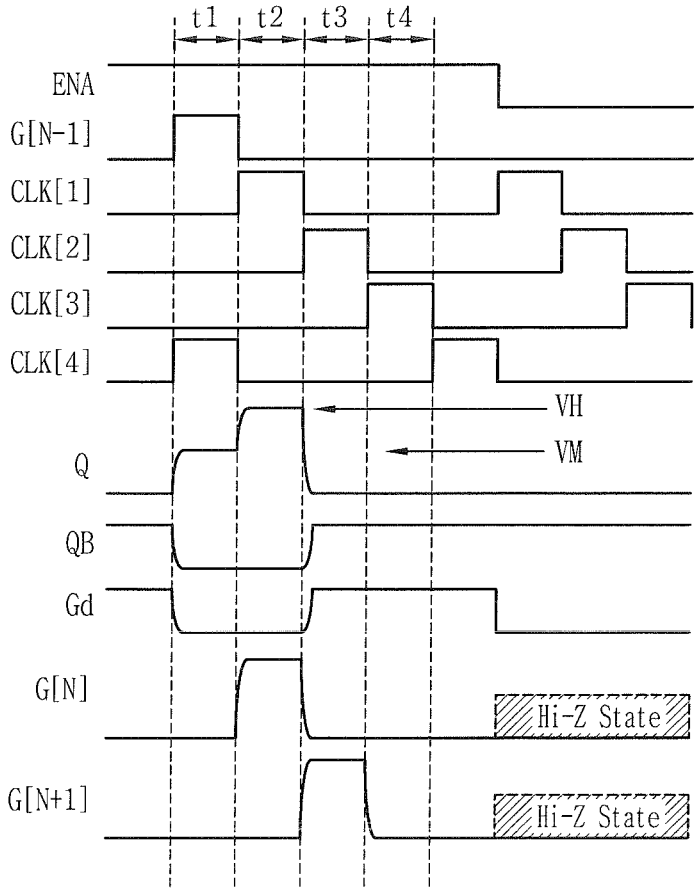
FIG. 9 shows waveforms of each part in FIG. 8.

The gate driver circuit as shown in FIG. 8 is one of the gate drivers GD11~GD1*n* and GD21~GD2*n* constituting the gate driving units 92A and 92B which operates at every odd number frame or even number frame. In the operation frame mode, the enable signal ENA is supplied with a high level from the timing controller 91 as shown in FIG. 9.

At the interval t1 in a charge mode, a gate signal G[N−1] of a previous stage is inputted with a high level to the set terminal (S) of the RS flipflop FF21, so a voltage VM of an intermediate level is outputted to the output terminal (Q), and accordingly, the charging transistor $T_U$ of the large size is turned on. The voltage VM of intermediate level is obtained by subtracting a threshold voltage of the input terminal transistor from a supplied voltage ($V_{DD}$−$V_{TH}$).

At this time, the reset signal RESET is inputted with a low level to the reset terminal (R) of the RS flipflop FF21, so the low-level signal is outputted to the inversion output terminal QB, and accordingly, because the signal of low level is outputted to the output terminal Gd of the AND gate AD21, the charging transistor $T_{PD}$ of the small size is turned off.

Thereafter, at the interval t2 in the charge mode, a clock signal (CLK=CLK[1]) is inputted with a high level. Accordingly, because of a coupling phenomenon of a parasitic capacitance $C_{gd}$ between the gate electrode and the drain electrode of the charging transistor $T_{PU}$, the voltage of the output terminal (Q) is bootstrapped to a voltage VH with a higher level as the voltage VM of the intermediate level and the voltage $V_{GH}$ of the clock signal CLK are added thereto.

Accordingly, the gate signal G[N] is outputted with the voltage level VGH of the clock signal CLK from a corresponding gate driver at the interval t2.

The gate signal G[N] outputted from the corresponding gate driver is commonly supplied to the corresponding gate line of the liquid crystal panel 84 and to the set terminal (S) of the RS flipflop FF21 of the gate driver of the next stage.

Thereafter, at the interval t3 in a discharge mode, the clock signal (CLK=CLK[1]) is dropped to a voltage VGL of a low level and a clock signal (CLK=CLK[2]) supplied to a gate driver of the next stage is increased to a high level voltage. At this time, a gate signal G[N−1] of a previous stage is inputted with a low level to the set terminal (S) of the RS flipflop FF21. Accordingly, the charging transistor $T_U$ is turned off.

At this time, the reset signal RESET is inputted with a high level to the reset terminal (R) of the RS flipflop FF21, so the high level signal is outputted to the inversion output terminal QB, and accordingly, because the high level signal is outputted to the output terminal Gd of the AND gate AD21, the discharging transistor $T_{PD}$ is turned on. Accordingly, a discharging operation of the gate signal G[N] is performed through the discharging transistor $T_{PD}$, and thus, the potential of the corresponding gate line transitions to a low level.

Thereafter, when the enable signal ENA transitions to a low level, the terminal of the gate signal G[N] is changed to a floating state, namely, to a high impedance state (Hi-Z).

FIG. 10 shows an operation timing diagram of the gate drivers operating as shown in FIG. 8 by discriminating the odd number frame and the even number frame. For the sake of explanation, outputs of the first gate drivers GS11~GD1*n* are expressed as GO[1]~GO[N], and outputs of the second gate drivers GD21~GD2*n* are expressed as GE[1]~GE[N].

Namely, in the odd number frame, an enable signal ENAO is supplied with a high level to an arbitrary gate driving unit, e.g., the first gate drivers GD11~GD1*n* of the first gate driving unit 92A, and as the first gate drivers GD11~GD1*n* sequentially generate the gate signals G0[1]~G0[N] in synchronization with the clock signal CLKO to. At this time, the output terminals of the second gate drivers GD21~GD2*n* of the second gate driving unit 92B are in a floating state (Hi-Z).

In the even number frame, conversely, the enable signal ENAO is supplied with a high level to the second gate drivers GD21~GD2*n* of the second gate driving unit 92B, and the second gate drivers GD21~GD2*n* sequentially generate the gate signals G0[1]~G0[N] in synchronization with the clock signal CLKE. At this time, the output terminals of the first gate drivers GE11~GE1*n* of the first gate driving unit 92A are in the floating state (Hi-Z).

Figure 11:
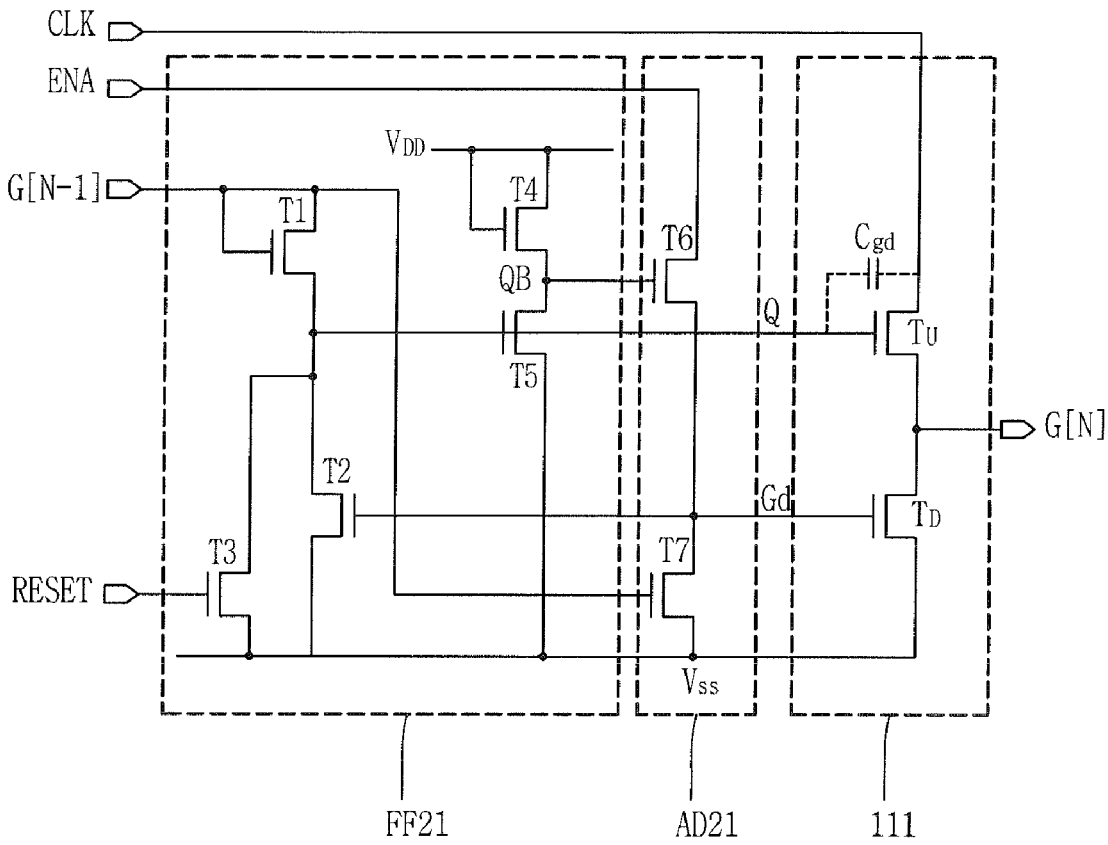
FIG. 11 is a detailed circuit diagram showing an example of implementation of gate drivers in FIG. 8.

FIG. 11 is a detailed circuit diagram showing an example of implementation of the gate drivers GD11~GD1*n* and GD21~GD2*n* in FIG. 8, and its operation will now be described with reference to FIGS. 9 to 11. Here, first to fifth transistors T1~T5 are elements of the RS flipflop FF21, sixth and seventh transistors T6 and T7 are elements of the AND gate AD21, and the charging transistor TPU and the discharging transistor TPD are elements of a gate signal output unit 111. In FIG. 11, it is shown that the first gate drivers GD11~GD1*n* and the second gate drivers GD21~GD2*n* are not discriminated.

When the gate signal G[N−1] of the previous stage is inputted with a high level, the diode connection type first transistor T1 is turned on, through which the voltage VM of intermediate level is outputted to the output terminal (Q). The gate signal G[N]−1 of the previous stage is a signal inputted to the set terminal (S).

At this time, the reset signal RESET is inputted with a low level, so the third transistor T3 is maintained in an OFF state. In this state, the fifth transistor T5 is turned on by the high level signal outputted via the first transistor T1 to maintain the potential of the inversion output terminal QB in a low level, and accordingly, the sixth transistor T6 is turned off to prevent the enable signal ENA from being transferred to the output terminal Gd. At this time, because the seventh transistor T7 is turned on by the gate signal G[N−1] of the high level of the previous stage, the potential of the output terminal Gd of the AND gate AD21 is maintained at a low level. Thus, the charging transistor $T_{PU}$ of the gate signal output unit 111 is turned on, while the discharging transistor $T_{PD}$ is turned off.

Thereafter, when the gate signal G[N]−1 of the previous stage transitions to the low level and subsequently the clock signal CLK is inputted with a high level, the voltage of the output terminal (Q) of the RS flipflop FF21 is bootstrapped to the voltage VH of a higher level as the voltage VM of the intermediate level and the voltage $V_{GH}$ of the clock signal CLK are added thereto, due to a coupling phenomenon of the parasitic capacitance $C_{gd}$ between the gate electrode and drain electrode of the charging transistor $T_{PU}$. Accordingly, the gate signal G[N] is outputted with the voltage level $V_{GH}$ of the clock signal CLK from the gate signal output unit 111.

Thereafter, the clock signal CLK transitions to a low level, and the reset signal RESET is inputted with a high level. Accordingly, the third transistor T3 is turned on and the voltage of the output terminal (Q) is muted to a ground terminal $V_{SS}$ via the third transistor T3, and thus, the voltage of the output terminal (Q) transitions to a low level. Accordingly, the charging transistor $T_{PU}$ is turned off.

As described above, when the gate signal G[N−1] of the previous state transitions to the low level, the diode connection type first transistor T1 is turned off. Accordingly, the fifth transistor T5 is turned off, and accordingly, the high level signal is outputted to the inversion output terminal QB via the diode connection type fourth transistor T4.

Accordingly, the sixth transistor T6 is turned on, and after the gate signal G[N−1] of the previous stage transitions to the low level, the seventh transistor T7 is maintained in a turned-off state. Accordingly, the high level signal is outputted to the output terminal Gd of the AND gate AD21, and accordingly, the discharging transistor $T_{PD}$ is turned on. Accordingly, a discharging operation of the gate signal G[N] is performed through the discharging transistor $T_{PD}$.

Figure 12A:
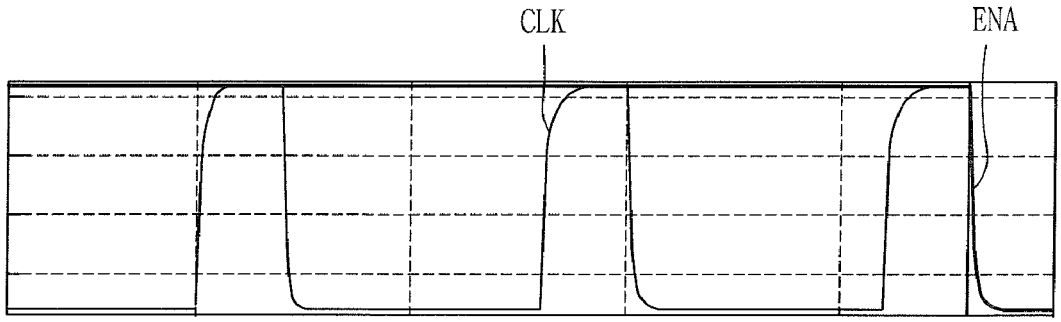
FIGS. 12*a* to 12*c* show waveforms obtained from simulation results of the gate driving units according to the first embodiment of the present invention.
Figure 12B:
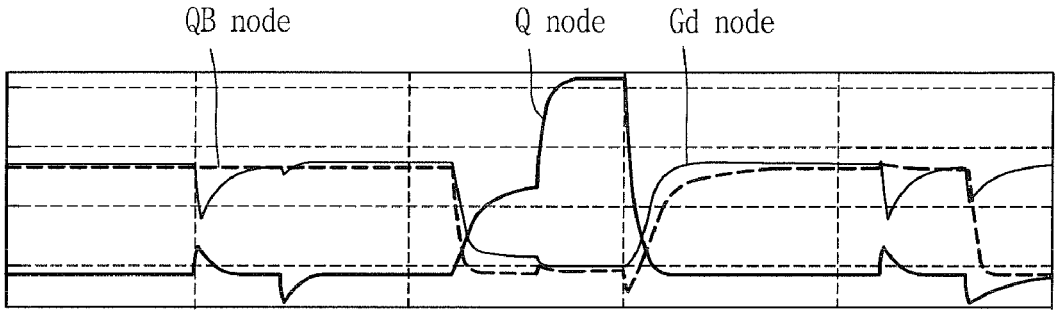
Figure 12C:
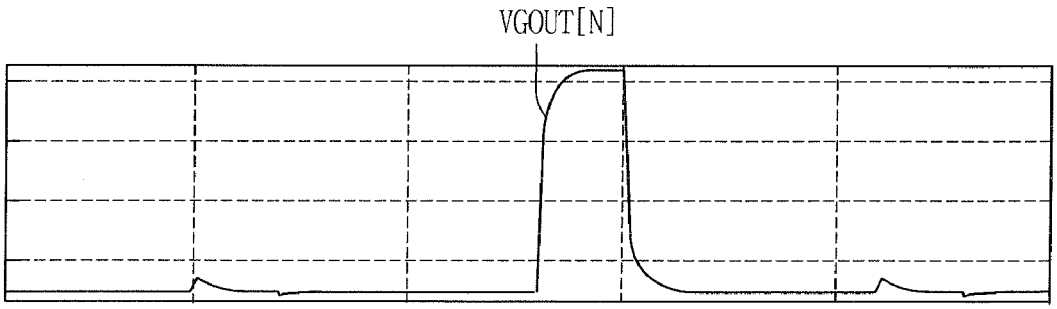

FIGS. 12*a* to 12*c* show waveforms obtained from simulation results of the operation of the gate driving units 92A and 92B in the driving circuit of the LCD according to the first embodiment of the present invention. Namely, it is noted that when potentials of the output node (Q) and the inversion output node QB of the RS flipflop FF21, and the output node Gd of the AND gate AD21 are normally generated as described above and the enable signal ENA transitions to the low level, the output node Gd of the AND gate AD21 becomes low level, so the terminal of the gate signal G[N] is changed to the high impedance state (Hi-Z).

Figure 13:
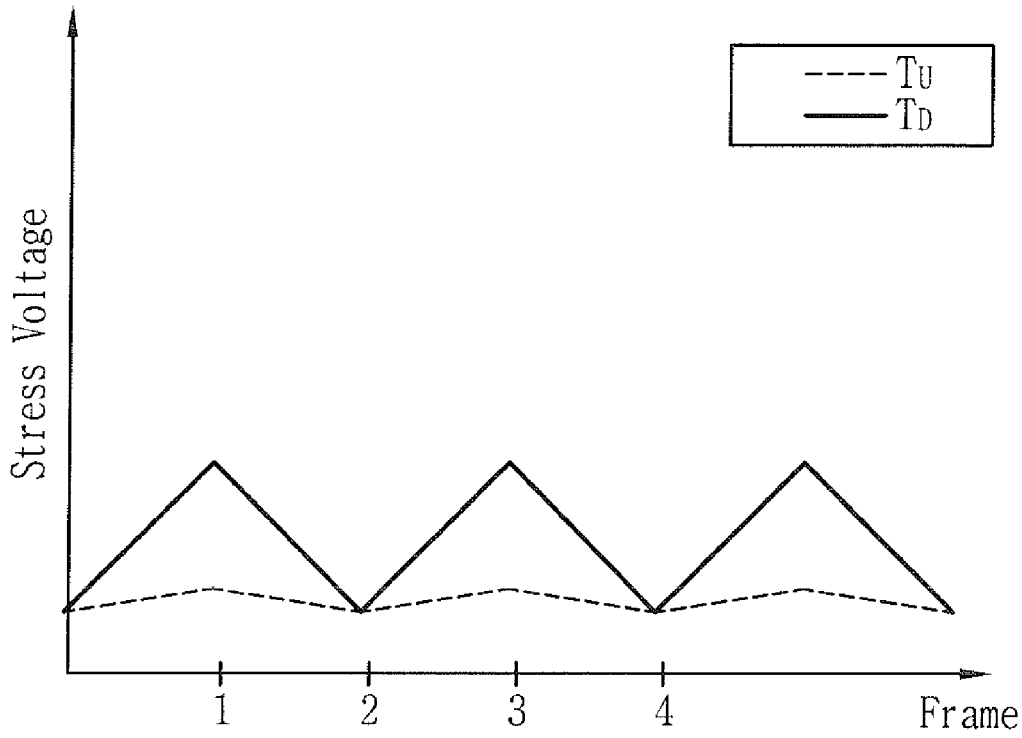
FIG. 13 is a graph showing waveforms of an accumulated stress voltage of transistors of a gate driver according to the first embodiment of the present invention.

FIG. 13 is a graph showing waveforms of an accumulated stress voltage of the charging transistor $T_{PU}$ and the discharging transistor $T_{PD}$ of the gate signal output unit 111 in the gate drivers GD11~GD1*n* and GD21~GD2*n* of the gate driving units 92A and 92B, in the driving circuit of the LCD according to the first embodiment of the present invention.

As shown, the accumulated stress voltage of the charging transistor $T_{PU}$ is little increased from an initial low value, and that of the discharging transistor $T_{PD}$ is slightly increased and then completely removed. Based on this, it can be noted that, in the driving circuit of the LCD according to the first embodiment of the present invention. The discharging operation of the gate line is quickly performed.

The LCD according to the first embodiment of the present invention with such configuration is advantageous in that the pair of gate driving units provided for the single liquid crystal panel are alternately driven by frames to prevent accumulated stress voltage from being continuously supplied to the discharging transistor and charging transistor of each gate driver of the gate driving units.

Thus, degradation of the characteristics of the discharging transistor and the charging transistor can be prevented and the gate line is quickly discharged, improving the reliability.

The driving circuit of the LCD according to a second embodiment of the present invention will now be described with reference to FIGS. 14 to 19.

Figure 14:
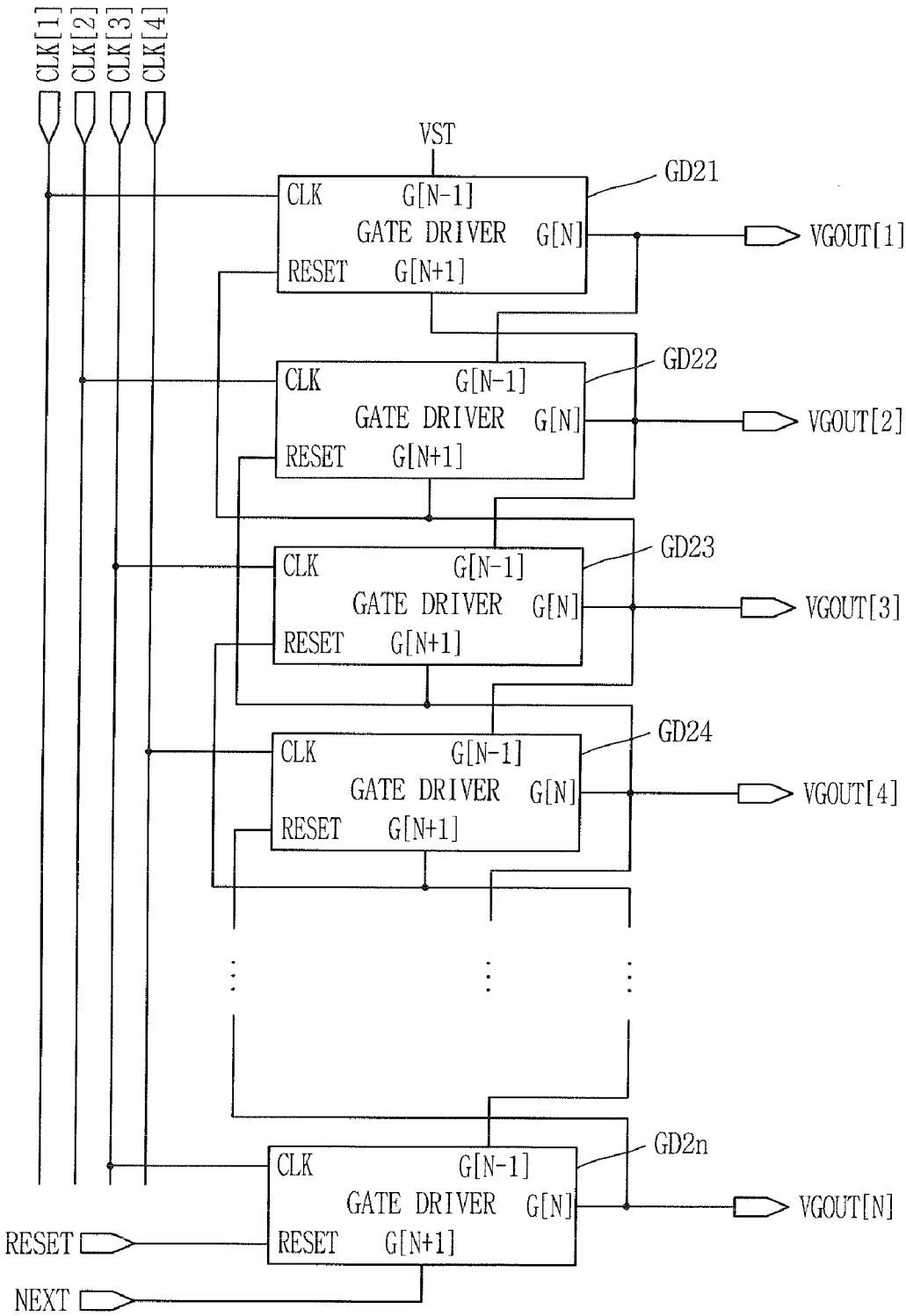
FIG. 14 is a block diagram of a gate driving circuit of a LCD according to a second embodiment of the present invention.

FIG. 14 shows a gate driving circuit as a driving circuit of an LCD according to a second embodiment of the present invention. With reference to FIG. 14, the driving circuit of the LCD according to the second embodiment of the present invention includes gate drivers GD21~GD2*n* sequentially driven in synchronization with clock signals CLK1~CLK4 to output gate signals VGOUT[1]~VGOUT[N] to the gate lines of the liquid crystal panel, and gate signals are discharged through both the charging transistor and the discharging transistor of the gate drivers GD21~GD2*n* in a discharge interval.

Figure 15:
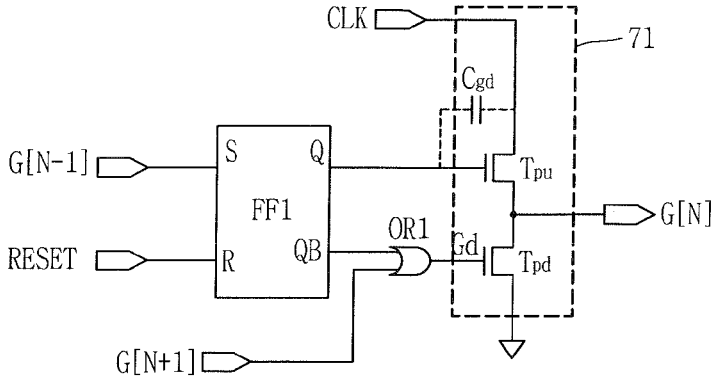
FIG. 15 is a circuit diagram of a gate driver in FIG. 14.

FIG. 15 is a detailed circuit diagram showing gate drivers GD21~GD2*n* in the driving circuit of the LCD according to the second embodiment of the present invention. With reference to FIG. 15, the gate driver includes an RS flipflop FF1 for outputting the opposite logic signals to two output terminals Q and QB according to a set signal and a reset signal; an OR gate OR1 for ORing a signal outputted from the inversion output terminal QB of the RS flipflop FF1 and a gate signal G[N+1] of a next stage; a charging transistor $T_{PU}$ for outputting a gate signal G[N] to a corresponding gate line of the liquid crystal panel according to a signal outputted from the output terminal (Q) of the RS flipflop FF1 and a clock signal at a charge interval and discharging the gate signal G[N] by maintaining a turned-on state at a discharge interval; and a discharging transistor $T_{PD}$ turned on by an output signal of the OR gate OR1 to discharge the gate signal G[N] at the discharge interval.

The driving of the driving circuit of the LCD according to the second embodiment of the present invention will now be described in detail with reference to FIGS. 16 to 20.

With reference to FIG. 14, the gate drivers GD21~GD2*n* that output the gate signals VGOUT[1]~VGOUT[N] to the respective gate lines of the liquid crystal panel while being driven with a shift register in synchronization with the clock signals CLK1~CLK4, are implemented such that gate signals are discharged through all the charging transistors and the discharging transistors of the gate drivers GD21~GD2*n* at the discharge interval, to thus perform discharging quickly.

FIG. 15 illustrates only one of the gate drivers GD21~GD2*n* for the sake of brevity, and its operation will now be described with reference to FIG. 18.

First, at the interval t1, a gate signal G[N−1] of a previous stage is inputted with a high level to the set terminal (S) of the RS flipflop FF21, so a voltage VM of an intermediate level is outputted to the output terminal (Q), and accordingly, the charging transistor $T_U$ of the large size is turned on. However, because the clock signal (CLK=CLK[1]) is still inputted with the low level, the gate signal G[N] is outputted as the voltage VGL of the low level. The voltage VM of intermediate level is obtained by subtracting a threshold voltage of the input terminal transistor from a supplied voltage ($V_{DD}-V_{TH}$).

At this time, the reset signal RESET is inputted with a low level to the reset terminal (R) of the RS flipflop FF21, so the low-level signal is outputted to the inversion output terminal QB and the gate signal G[N+1] of the next stage is outputted with a low level, and accordingly, the low level signal is outputted to the output terminal Gd of the OR gate OR1, and thus, the charging transistor $T_{PD}$ of the small size is turned off.

Thereafter, at the interval t2, the clock signal (CLK) is inputted with a high level. Accordingly, because of a coupling phenomenon of a parasitic capacitance $C_{gd}$ between the gate electrode and the drain electrode of the charging transistor TPU, the voltage of the output terminal (Q) is bootstrapped to a voltage VH with a higher level as the voltage VM of the intermediate level and the voltage $V_{GH}$ of the clock signal CLK are added thereto. Accordingly, the gate signal G[N] is outputted with the voltage level $V_{GH}$ of the clock signal CLK from a corresponding gate driver at the interval t2.

Thereafter, at the interval t3, the clock signal CLK is dropped to a voltage VGL of low level, and due to the coupling phenomenon of the parasitic capacitance $C_{gd}$, the voltage supplied to the gate electrode of the charging transistor $T_{PU}$ is dropped to the voltage VM of the intermediate level, which is then, maintained.

Accordingly, the charging transistor $T_{PU}$ is maintained in the turned-on state, and accordingly, the gate signal G[N] is discharged as a low level voltage VGL via the charging transistor $T_{PU}$.

Simultaneously, the gate signal G[N+1] is outputted with a high level from the gate driver of the next stage to which the clock signal CLK[2] is supplied, and accordingly, the high level signal is outputted to the output terminal Gd of the OR gate OR1. Accordingly, the discharging transistor $T_{PD}$ is turned on, through which the discharging operation of the gate signal G[N] is performed.

Because the discharging operation of the gate signal G[N] is performed simultaneously through the charging transistor $T_{PU}$ and the discharging transistor $T_{PD}$ at the discharge interval t3, the discharging operation can be quickly performed compared with the general case where the discharging operation is performed through only one discharging transistor $T_{PD}$, so a falling time of the gate signal G[N] can be shortened.

Thereafter, at the interval t4, the gate signal G[N+2] is inputted with a high level from the gate driver of the second stage to the reset terminal (R) of the RS flipflop FF1. Accordingly, a low level signal is outputted to the output terminal (Q) of the RS flipflop FF1 to turn off the charging transistor TPU. In this case, however, because the high level signal is continuously outputted to the inversion output terminal QB, the high level signal is also continuously outputted from the OR gate OR1. Accordingly, the discharging transistor $T_{PD}$ is maintained in the turned-on state to continuously perform discharging operation of the gate signal G[N].

Figure 17:
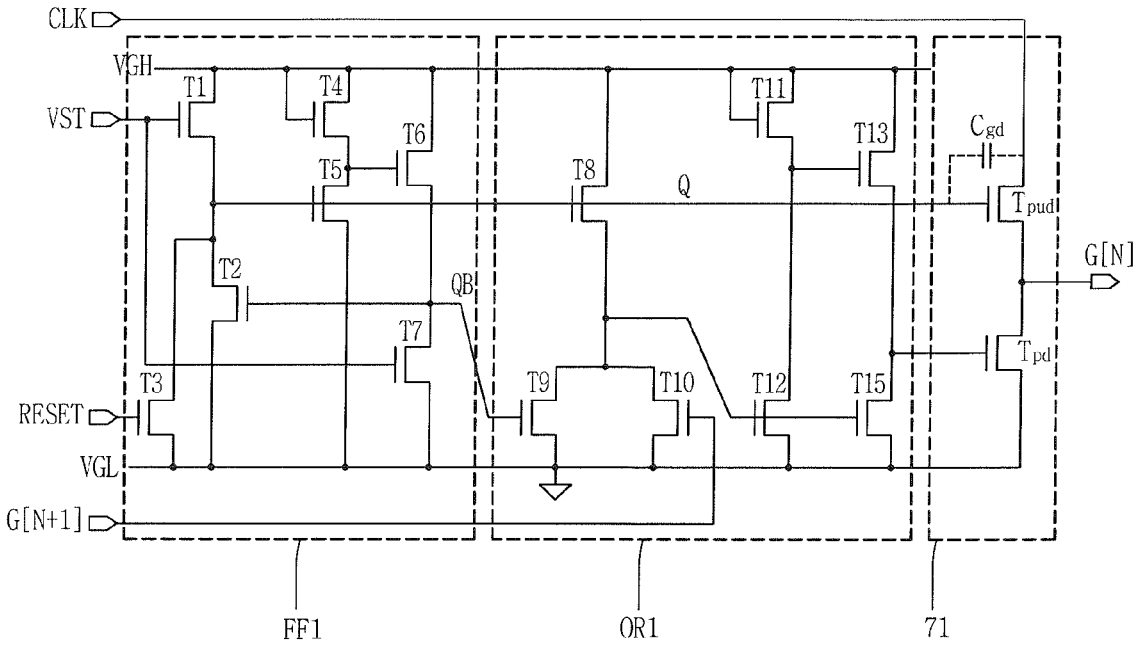
FIG. 17 is a detailed circuit diagram showing an example of implementation of the gate driver in FIG. 15.

FIG. 17 is a detailed circuit diagram showing an example of implementation of the gate driver in FIG. 15. As shown in FIG. 17, the gate driver includes an RS flipflop FF1 including first to seventh transistors T1~T7; an OR gate OR1 including eighth to $15^{th}$ transistors T8~T15; and a gate signal output unit 71 including the charging transistor $T_{PU}$ and the discharging transistor $T_{PD}$.

In the RS flipflop FF1, in FIG. 15, when the start signal VST corresponding to the gate signal G[N−1] of the previous stage is inputted with a high level, the first transistor T1 is turned on to output a high level signal to the output terminal (Q). Thereafter, when the reset signal RESET is inputted with a high level, the third transistor T3 is turned on to make a signal of the output terminal (Q) is muted to the ground terminal via the third transistor T3, so the output terminal (Q) has a low level signal. At this time, the fifth transistor T5 is turned off by the low level signal outputted from the output terminal (Q), a high level signal is supplied to a gate electrode of the sixth transistor T6 via the diode connection type fourth transistor T4 to turn on the sixth transistor T6. At this time, the start signal VST is inputted with a low level to turn off the seventh transistor T7. Accordingly, a high level signal is outputted to the inversion output terminal QB via the sixth transistor T6.

In the OR gage OR1, when the output signal of the inversion output terminal QB of the RS flipflop FF1 to turn on the ninth transistor T9 or when the gate signal G[N+1] of the next stage is inputted with a high level to turn on the tenth transistor T10, the $12^{th}$ transistor T12 and the $15^{th}$ transistor T15 are turned off. At this time, a high level signal is supplied to a gate electrode of the $13^{th}$ transistor T13 via the diode connection type $11^{th}$ transistor to turn on the $13^{th}$ transistor. Accordingly, the high level signal is inputted to the output terminal Gd via the $13^{th}$ transistor T13.

The gate signal output unit 71 is operated as described above with reference to FIG. 15. Namely, in the charge mode, the charging transistor $T_{PU}$ is turned on by the signal of the output terminal QB of the RS flipflop FF1 to output the gate signal G[N] to the corresponding gate line of the liquid crystal panel. In the discharge mode, the discharging transistor $T_{PD}$ is turned on by the output signal of the OR gate OR1 to discharge the gate signal G[N] via the discharging transistor $T_{PD}$. At this time, the charging transistor $T_{PU}$ is also maintained in the turned-on state, through which discharging is also performed.

Figure 18:
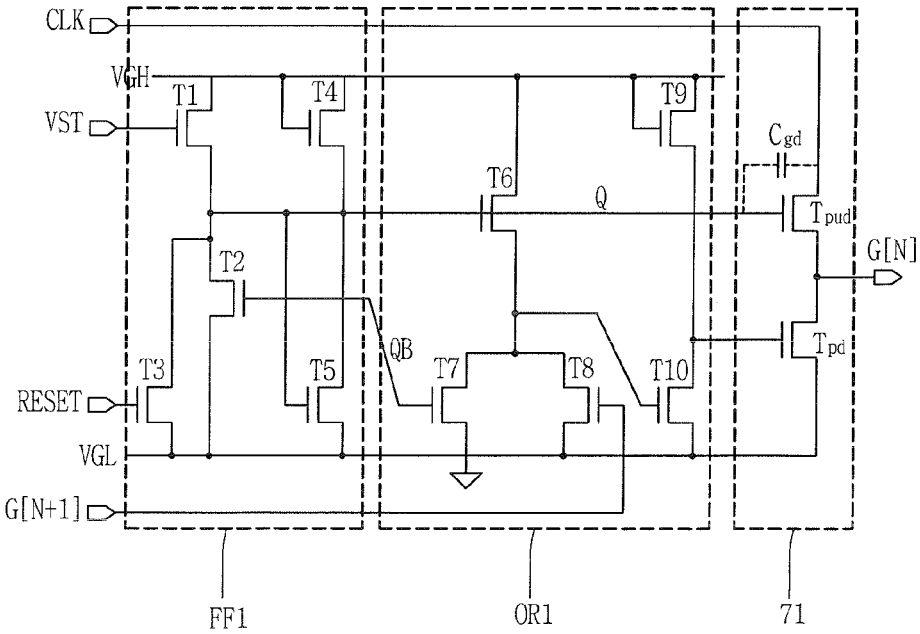
FIG. 18 is a detailed circuit diagram showing another example of implementation of the gate driver in FIG. 15.

FIG. 18 is a detailed circuit diagram showing another example of implementation of the gate driver in FIG. 15. As shown in FIG. 18, the gate driver includes an RS flipflop FF1 including first to fifth transistors T6~T10; an OR gate OR1 including sixth to $10^{th}$ transistors T6~T10; and a gate signal output unit 71 including the charging transistor $T_{PU}$ and the discharging transistor $T_{PD}$.

Compared with the gate driver as shown in FIG. 17, the gate driver as shown in FIG. 18 is different in that the RS flipflop FF1 and the OR gate OR1 have a simple structure and thus power consumption can be reduced.

In the RS flipflop, in FIG. 15, when the start signal VST corresponding to the gate signal G[N−1] is inputted with a high level, the first transistor T1 is turned on to output the high level signal to the output terminal (Q). Thereafter, when the reset signal RESET is inputted with a high level, the third transistor T3 is turned on to make the signal of the output terminal (Q) muted to the ground terminal via the third transistor T3, so the output terminal (Q) has a low level. At this time, the fifth transistor T5 is turned off by the low level signal outputted from the output terminal (Q), a high level signal is outputted to the inversion output terminal QB via the diode connection type fourth transistor T4.

In the OR gate OR1, when the output signal of the inversion output terminal QB of the RS flipflop FF1 is inputted with a high level to turn on the seventh transistor T7 or when the gate signal G[N+1] of the next stage is inputted with a high level to turn on the eighth transistor T8, the $10^{th}$ transistor T10 is turned off. At this time, the high level signal is outputted to the output terminal Gd via the diode connection type ninth transistor T9.

The gate signal output unit 71 operates in this manner as described above with reference to FIGS. 15 to 17.

Figure 16:
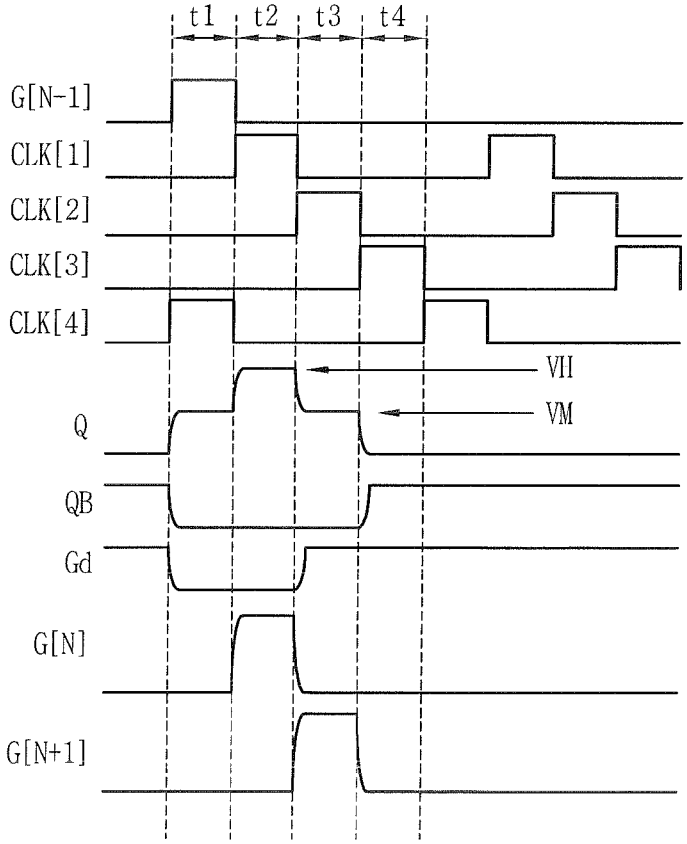
FIG. 16 shows waveforms of signals outputted from each part in FIG. 15.
Figure 19:
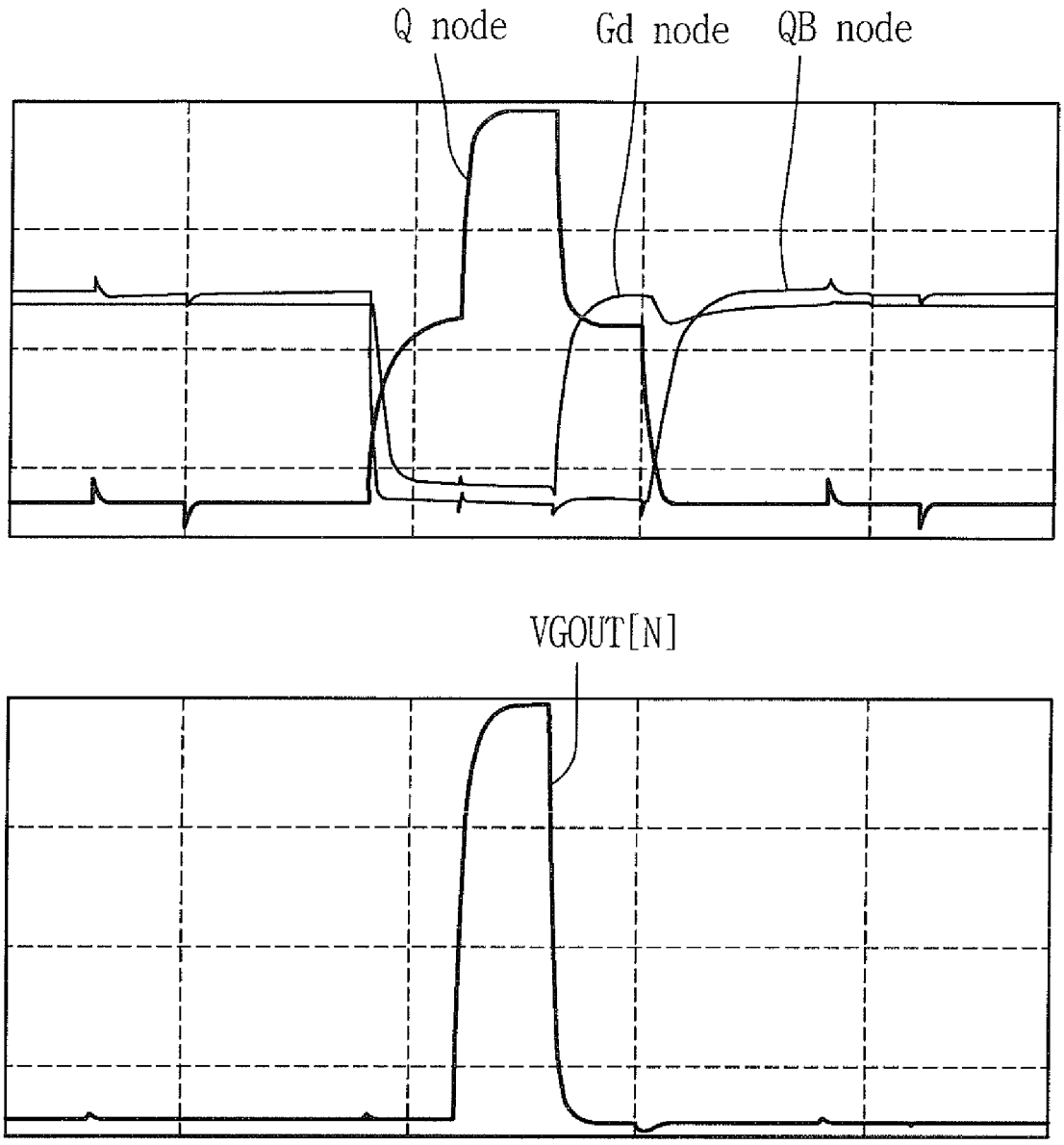
FIG. 19 shows waveforms of simulation results with respect to the gate driving circuit according to the second embodiment of the present invention.

FIG. 19 shows waveforms of simulation results with respect to the gate driving circuit according to the second embodiment of the present invention. It is noted that the voltages of the respective output terminals Q node, QB node, and Gd node appear as shown in FIG. 16, and accordingly, the gate signal VGOUT[N] is quickly discharged at the discharge interval.

Figure 20:
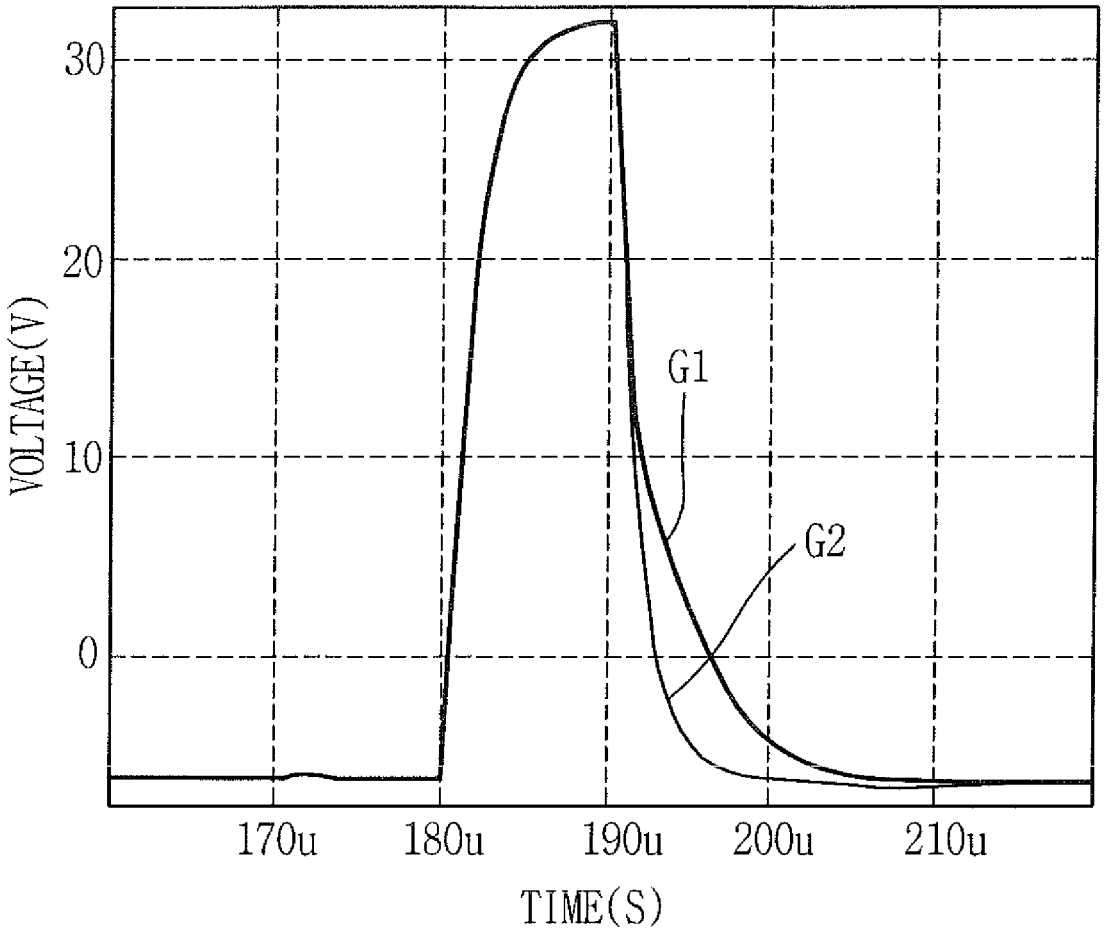
FIG. 20 is a graph comparatively showing waveforms of output signals of the gate driver according to the second embodiment of the present invention.

FIG. 20 shows the simulation results with respect to the output characteristics of the gate drivers GD21~GD2*n*. As shown, when the gate signal G1 outputted from the gate driver in the related art and the gate signal G2 outputted from the gate driver according to the present invention, it can be noted that a falling time is considerably shortened.

As described above, in the driving circuit of the LCD according to the second embodiment of the present invention, when the gate signal is discharged via the discharging transistor after outputting the gate signal to the gate line, discharging is also performed through the charging transistor, so the gate line can be quickly discharged, to thus improve the reliability.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A driving circuit of a liquid crystal display device, comprising:

a timing controller to output a gate control signal and a data control signal to control driving of a gate driving unit and a data driving unit and to output digital video data;

a pair of gate driving units to be alternately driven by using at least one frame as a period to supply gate signals to gate lines of a liquid crystal panel in response to the gate control signal; and a data driving unit to supply pixel signals to data lines of the liquid crystal panel in response to the data control signal, wherein the pair of gate drivers include gate drivers driven like a shift register, respectively, and are alternately selected to be driven by using at least one frame as a period by an enable signal supplied from the timing controller, wherein the gate driver comprises:

an RS flipflop that outputs the opposite logic signals to an output terminal and an inversion output terminal according to a set signal and a reset signal;

an AND gate that ANDs a signal outputted from the inversion output terminal of the RS flipflop and the enable signal to validate it with an odd number of even number frame period; and a gate signal output unit driven by an output signal of the RS flipflop and the AND gate to generate a gate signal.

2. The driving circuit of claim 1, wherein the RS flipflop is configured such that a set terminal is connected to an output terminal via a diode connection type first transistor and the connection point is connected to a ground terminal via second and third transistors which are connected in parallel, and a power terminal (VDD) is connected to the inversion output terminal via a fourth transistor and the connection point is connected to a ground terminal via a fifth transistor.

3. The driving circuit of claim 1, wherein the AND gate is configured such that an enable terminal is connected to the inversion output terminal via a sixth transistor and the connection point is connected to a ground terminal via a seventh transistor, and gate electrodes of the sixth and seventh transistors are connected to the inversion output terminal and the set terminal, respectively.

4. The driving circuit of claim 1, wherein the gate signal output unit includes a charging transistor and a discharging transistor connected in series between a clock signal terminal and a ground terminal and having gate electrodes connected with the output terminal and the inversion output terminal of the RS flipflop to generate a gate signal from a common connection point of a drain electrode and a source electrode.

5. The driving circuit of claim 4, wherein the charging transistor is configured to be turned on by a voltage outputted from the output terminal of the RS flipflop to output a voltage of an intermediate level and then output a voltage increased up to a voltage level of a clock signal inputted to the source terminal.

6. The driving circuit of claim 4, wherein when an enable signal transitions to a low level, the discharging transistor makes a terminal of the output signal turned to a floating state.

* * * * *